US007313907B2

(12) United States Patent
Fare'

(10) Patent No.: US 7,313,907 B2
(45) Date of Patent: Jan. 1, 2008

(54) APPARATUS AND METHOD FOR TREATING SYNTHETIC YARNS

(75) Inventor: Rosaldo Fare', Fagnano Olona (IT)

(73) Assignee: Fare' S.p.A., Fagnano Olona (VA) (IT)

( * ) Notice: Subject to any disclaimer, the term of this patent is extended or adjusted under 35 U.S.C. 154(b) by 162 days.

(21) Appl. No.: 11/189,015

(22) Filed: Jul. 26, 2005

(65) Prior Publication Data

US 2006/0021206 A1 Feb. 2, 2006

(30) Foreign Application Priority Data

Jul. 28, 2004 (EP) ..... 04425569

(51) Int. Cl.
*D01H 13/00* (2006.01)

(52) U.S. Cl. ..... 57/350

(58) Field of Classification Search ..... 57/243, 57/246, 289, 333, 350, 403, 908
See application file for complete search history.

(56) References Cited

U.S. PATENT DOCUMENTS

| | | | | |
|---|---|---|---|---|
| 2,622,961 A | | 12/1952 | Finlayson et al. | |
| 3,655,862 A | | 4/1972 | Dorschner et al. | |
| 4,346,504 A | | 8/1982 | Birk et al. | 28/240 |
| 4,569,193 A | * | 2/1986 | Anahara et al. | 57/328 |
| 4,934,133 A | * | 6/1990 | Stalder et al. | 57/333 |
| 5,261,472 A | * | 11/1993 | Knox et al. | 139/420 A |
| 5,326,009 A | * | 7/1994 | Kobayashi et al. | 226/97.4 |
| 5,433,365 A | * | 7/1995 | Davies | 226/97.4 |
| 5,481,863 A | * | 1/1996 | Ota | 57/328 |
| 6,029,435 A | * | 2/2000 | Okamoto | 57/261 |
| 6,438,934 B1 | * | 8/2002 | Foster et al. | 57/328 |
| 6,701,704 B2 | * | 3/2004 | Foster et al. | 57/333 |
| 2003/0042651 A1 | | 3/2003 | Najour et al. | 264/211.14 |

FOREIGN PATENT DOCUMENTS

| | | |
|---|---|---|
| WO | 93/24693 | 12/1993 |
| WO | 02/063087 A1 | 8/2002 |
| WO | 03/012179 A2 | 2/2003 |

OTHER PUBLICATIONS

European Search Report of EP 04 42 5569 mailed Jun. 27, 2005.

* cited by examiner

*Primary Examiner*—Shaun R. Hurley
(74) *Attorney, Agent, or Firm*—Nixon & Vanderhye P.C.

(57) ABSTRACT

The present invention relates to equipment/apparatus, and the relative method/process, for the treatment of synthetic filaments, in particular for drawing said filaments, comprising at least two nozzles each provided with a main passage, through which said yarns pass, having a section variable between an inlet portion and an outlet portion and into which at least one supply channel opens to supply a fluid according to a preferential direction. Advantageously, the nozzles are provided in line and the sections of the main passage of the second nozzle have an area at least 3% larger than the corresponding sections of the main passage of the first nozzle.

12 Claims, 2 Drawing Sheets

APPARATUS AND METHOD FOR TREATING SYNTHETIC YARNS

The present invention relates to equipment for the treatment of synthetic filaments in the production phase, in particular for the treatment of yarns in the spinning-drawing phase, to obtain a non-woven fabric.

It is known in the synthetic yarn production sector to use nozzle units supplied with pressurized polymer fluids to form yarns or filaments in the various phases.

In particular, for example, the spinning-drawing phase consists in the application, on the yarns/filaments delivered from a spinneret, of a force in the direction of their length. The drawing which the yarns undergo causes considerable elongation of the individual filaments of which they are composed and a consequent decrease in the diameter of said yarns. This treatment has the function of improving the characteristics of the yarns, for example making it possible to increase their strength, rigidity, resilience, sheen, softness and ultimate elongation.

For example, non-woven fabrics of the spunbonded type are generally obtained by treating one or more groups of filaments, delivered from spinnerets, by drawing and heat bonding. During the drawing phase, the groups of filaments typically pass through one or more nozzles supplied with compressed air at high speed. The compressed air produces a Venturi effect which sucks air from outside into these nozzles. Interaction between the air flow thus obtained and the individual filaments produces tension on said filaments in the direction of their length, which causes them to be drawn.

Although from now on reference will be made to the drawing of synthetic yarns, the invention is not intended as limited, in its application, exclusively to this process phase.

Conventionally, in systems to produce yarns, the nozzles for drawing are provided side by side, in rows, downstream of the spinnerets.

The nozzles according to the prior art are provided with a main passage, through which the yarns or groups of filaments delivered from the spinnerets run, and are provided with a channel destined to supply a fluid at high speed in the main passage. Usually, the fluid is compressed air supplied to the main channel in a direction essentially longitudinal to the direction in which the yarns run, or at most incident with this according to angles of moderate amplitude. The air flow passes through the main passage at high speed and interacts with the yarns, also travelling through the main passage, transmitting a force (tension) thereto which is sufficient to cause them to be elongated and thereby drawn. The fluid at high speed sucks air from outside the nozzle into the main passage through the Venturi effect. The flow rate and pressure of the air supplied to the nozzles can be regulated upstream thereof, acting on relative compressors or on analogous devices.

Also available on the market are nozzles whereon the rate and speed of the air flow supplied to the main channel can be regulated. Conventionally, this regulation was performed by suitably varying one or more sections of the air supply channel. In fact, the channel can be provided with a suitable narrowing of section having the function of accelerating the air flow and can be provided with means suitable to vary the dimensions of said section. For example, the supply channel can be delimited by movable surfaces, that is, it can have a variable geometry. In this way the speed of the air can be increased or decreased according to the requirements of the drawing process, for example according to the type of yarn to be drawn, its count and the tension to be applied.

The increase in speed or flow rate of air supplied to the nozzle corresponds to an increase in the tension applied to the yarns. Consequently, there is an increase in the speed at which the yarns run and thereby also an increase in the productivity of the system. Nonetheless, there is unfortunately also an increase in the losses of load relative to the circuit formed by the compressors and by the nozzles. These losses must be compensated with greater air consumption which increases the running costs, mainly due to a greater energy consumption by the compressors and by the maintenance they require.

Moreover, in order to increase the air flow rate supplied to the nozzle, or its speed in the nozzle, it is often necessary to increase the delivery pressure from the relative compressors. The air temperature increases together with the delivery pressure and to prevent said temperature from having a negative influence on the quality of the yarns treated suitable devices are provided to cool the air before it enters the nozzle. For example, the compressors can be equipped with intercoolers. A drawback lies in the fact that the cooling devices absorb large quantities of energy and therefore, when provided, reduce the overall yield of the drawing system.

The nozzles normally utilized for treatment of the yarns in phases other than drawing also have drawbacks similar to those relating to the nozzles conventionally used to draw yarns. For example, the nozzles provided for the interlacing phase of yarns cause considerable losses of load in the relative circuit.

An object of the present invention is to provide equipment, in particular a nozzle unit for the treatment of yarns, which overcomes the drawbacks of the nozzles conventionally used in the various processing phases of the yarns, which is also simple and inexpensive to produce.

A further object of the present invention is to provide equipment for continuous drawing of yarns which allows maximization of the tension transmitted to the yarns and at the same time minimization of the pressure and temperature of the fluid supplied to the nozzles.

Yet another object of the present invention is to provide equipment for drawing yarns which, with respect to prior art equipment, allows the productivity of the relative systems to be increased.

These and other objects are obtained by the present invention which relates to equipment for the treatment of synthetic filaments, comprising at least two nozzles, each provided with a main passage, through which said filaments pass, having a section variable between an inlet portion and an outlet portion and into which at least one channel opens to supply a fluid according to a preferential direction, characterized in that said at least two nozzles are provided in line, the outlet portion of the main passage of the first nozzle being in communication exclusively with the inlet portion of the main passage of the second nozzle, and in that the sections of the main passage of the second nozzle have a larger area than the corresponding sections of the main passage of the first nozzle, the increase in area being of at least 3%.

In the case in which said main passage is circular, the increase in diameter relative to the passage of said second nozzle, with respect to the diameter of the passage of said first nozzle, will be of at least 3%.

Preferably, the inlet portion and the outlet portion of the main passage of the first and of the second nozzle belong to separate elements of each nozzle. The surfaces which define the supply channel belong to these elements. For example, the supply channel can be an interstice obtained by juxtaposing corresponding surfaces of said elements.

The aforesaid elements can be movable with respect to one another, so that it is possible to effectively regulate the geometry of the supply channel and, consequently, to regulate the flow rate and speed of the fluid supplied.

The main passage of the nozzles can take different forms; for example, it can extend in an essentially tubular direction, with sections that are circular or geometrical (hexagons, squares, etc.) or it can be an interstice between opposite surfaces.

Preferably, the inlet portion of the main passage of each nozzle has an essentially tubular shape and the outlet portion has a first funnel-shaped part and a second cylindrical part. The inlet portion is at least in part inserted into the first part of the outlet portion, that is, into the conical portion, without there being contact therewith. The interstice between the inlet portion and the outlet portion is, in this embodiment, part of the supply channel.

According to an alternative embodiment of the present invention, the main passages of the nozzles are both defined by the totality of the surfaces of an external element, for example another nozzle unit, and of the surfaces of the elements of the first and of the second nozzle. In practice, according to this embodiment, each main passage is obtained by juxtaposing an external element to the relative nozzle so as to obtain a passage with the same characteristics as the preferred embodiment.

Preferably, in the case in which the main passages have circular sections, the inlet portion of the first nozzle can have, for example, an internal diameter of approximately 9 mm and the second part of its outlet portion, that is, its cylindrical portion, can have, for example, an internal diameter of approximately 12 mm. The inlet portion of the second nozzle has a minimum internal diameter, that is, the diameter of the narrowest section, of approximately 9.3 mm or greater than this value, and the second part of its outlet portion has a diameter of approximately 12.4 mm or greater.

According to one aspect of the invention, the coupling between the outlet portion of the main passage of the first nozzle and the inlet portion of the main passage of the second nozzle is airtight. Airtight coupling of the main passages of the first and of the second nozzle of the group allows optimization of the Venturi effect which is created in the main passage of the nozzles when the fluid supplied through the relative channels has a high speed.

The nozzle unit according to the invention is particularly suitable for drawing yarns, for example, synthetic yarns in polyamide, polyester or produced with olefin fibres. For this reason the aforesaid fluid, for example air, is preferably directed essentially in a longitudinal direction or slightly incident with the direction in which the yarns pass in the main passages.

The equipment provided with at least two nozzles in line according to the invention, if used to draw synthetic yarns makes it possible to obtain a considerable increase in performances with respect to equipment with one nozzle according to prior art. For example, the speed of the yarns treated can be doubled, and reach values of approximately 5000 m/minute.

The tensions transmitted to the yarns are also increased to reach double the value with respect to those currently obtainable with conventional equipment. Moreover, with the same tensions transmitted to the yarns, the nozzle units according to the invention require considerably lower air supply pressures, up to values of 50% with respect to the typical pressures of prior art equipment, with evident positive effects with regard to the energy consumption of the compressors and the air temperature supplied to the nozzles. In fact, the latter may be a few tens of degrees lower with respect to the typical temperatures of air supplied to conventional nozzles.

In practice, using the equipment according to the present invention, it is possible to use fluids, in particular air, at a lower pressure with respect to the pressure required with prior art equipment. Notwithstanding the fact that even considerably lower pressures are used, the results which are obtained with equipment according to the invention do not merely improve proportionally, but are much higher than expected. A reduction in the pressure of air supplied even of 50%, does not bring the same result (in terms of speed of the yarns and tensions applied) obtained with prior art equipment, but a better result. This aspect is entirely unexpected. Moreover, the reduction in the pressure of the fluid used leads to a decrease in the running costs, also due, for example, to the fact that energy consumption can be reduced on account of cooling of the fluid delivered from the compressor. In fact, in order not to jeopardize spinning-drawing operations, the fluid, in this case air used at a pressure of 0.8 bar, has a temperature of approximately 80° C., while it must reach the yarns delivered from the spinneret at a temperature ranging from 10 to 30° C. Cooling is therefore necessary. In the case of conventional systems, the air delivered at a pressure of 1.7 bar has a temperature of approximately 120° C. Therefore, in this case it must be cooled to a greater extent, with consequent increased energy consumption.

The lower pressures which can be used with the equipment according to the present invention, also allow different systems to compressors to be used to produce air or another pressurized fluid, such as high pressure fans, also in this case with evident economic advantages.

Further aspects and advantages of the present invention shall be apparent from the description below, provided purely as a non-limiting example with reference to the accompanying schematic drawings, in which.

Figure 1:
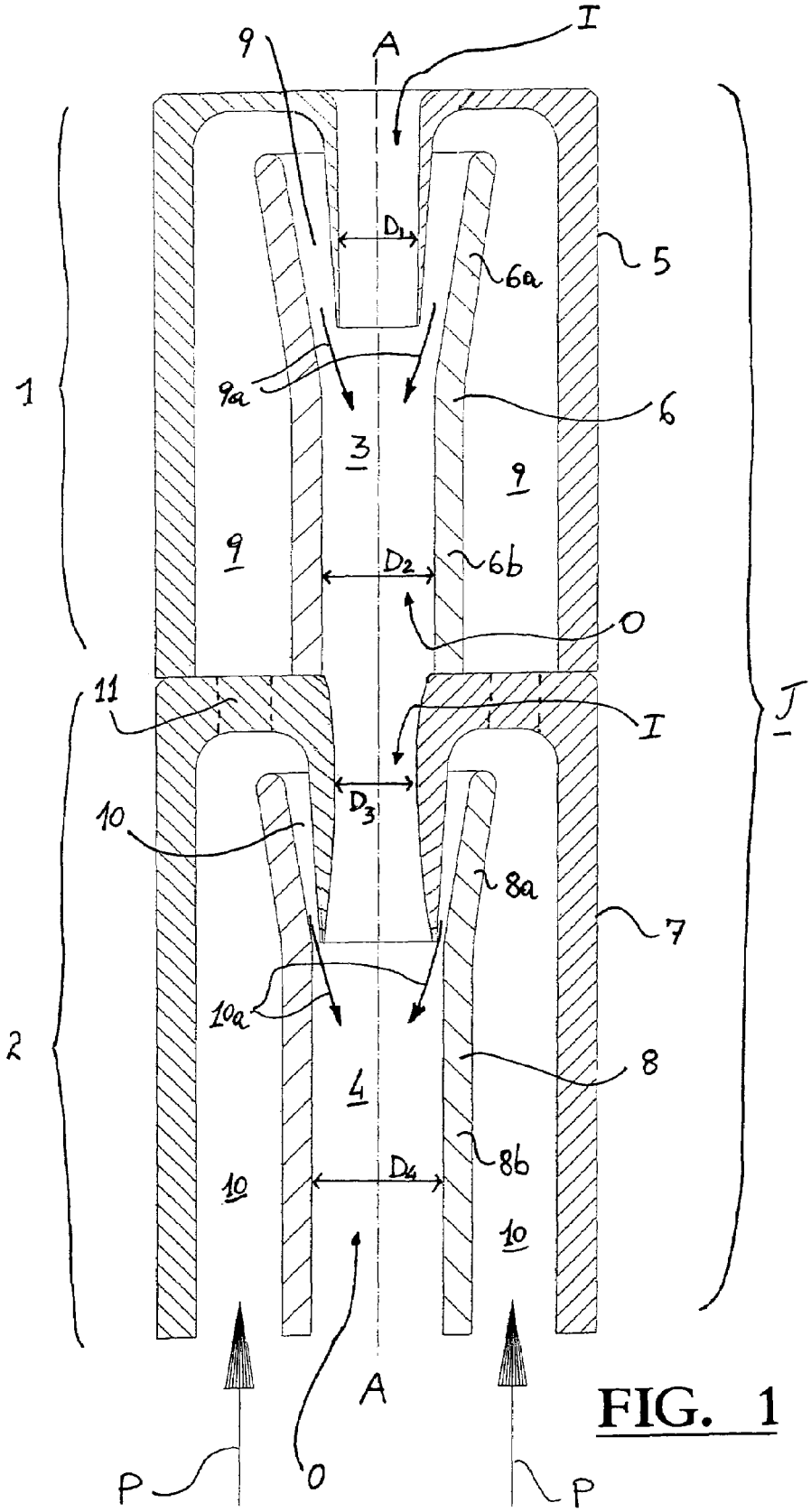
FIG. 1 shows a sectional schematic view of equipment comprising a nozzle unit according to the present invention.

FIG. 1 shows, schematically, a section of a nozzle unit J according to the present invention. The line A-A indicates approximately the trajectory followed by the moving yarns (not shown), delivered from the spinneret, which pass through the unit J. The section shown in FIG. 1 is considered on a plane containing the line A-A.

In general the unit J comprises at least a first nozzle 1 and at least a second nozzle 2 positioned in line with respect to the direction A-A, that is, respectively upstream and downstream according to the direction in which the yarns run. This configuration, as explained in the description below, has different advantages with respect to conventional equipment which generally has a single nozzle for treatment of the yarns, in particular in the case in which they are used for the drawing phase.

Preferably, each nozzle 1, 2 is provided with a main passage through which the yarns or groups of filaments to be treated pass. The nozzle 1 in FIG. 1 is provided with a main passage indicated with the reference number 3 and the nozzle 2 is provided with a main passage 4.

The main passages 3, 4 can in general have different shapes. For example, the passages 3, 4 in FIG. 1 extend in an essentially cylindrical direction, that is, the sections of said passages, considered on planes orthogonal to the line A-A, are circular. Alternatively, the sections of the passages 3, 4 can be geometrical, for example squares or hexagons, or can be configured as interstices between opposite surfaces.

Each main passage 3, 4 has an inlet portion I and an outlet portion O and in general is provided with at least one narrowing in section between the inlet I and the outlet O. This configuration makes it possible to obtain the Venturi effect when a fluid at high speed is supplied to the passages 3, 4. In this way, in fact, air is sucked from outside the unit J to the inlet I of the first nozzle 1.

The passages 3, 4 can be inside a single tubular element or, as shown in FIG. 1, they can be defined by the totality of the surfaces of separate elements. In particular, the passage 3 is obtained by the totality of the elements 5 and 6, while the passage 4 is obtained by the totality of the elements 7 and 8. The elements 5-6 and 7-8 are positioned next to each other, so as to produce at least one interstice between said elements 5-6 and 7-8. This interstice preferably forms a channel to supply a fluid to the passages 3 and 4.

In the case in which the nozzles 1 and 2 are circular, as shown in the embodiment in FIG. 1, the supply channels 9 (which are created between the elements 5 and 6) and 10 (which are created between the elements 7 and 8) have a generally conical shape. The supply channels 9 and 10 are supplied with a pressurized fluid, for example compressed air, and have the function of directing said fluid towards the yarns which pass in the passages 3 and 4. In general, the supply channels 9 and 10 are convergent, in order to increase the speed of the fluid supplied to the relative main passages 3 and 4. This direction is essentially longitudinal to the direction A-A, or incident with it according to angles of moderate amplitude.

The unit J can have means to regulate the flow of the pressurized fluid supplied to the nozzles 1, 2. For example, the unit J can be provided with valves for regulation of the flow rate of the fluid supplied. Preferably, these means will allow regulation of the flow rate or speed of the fluid through variation of the dimensions of at least one of the supply channels 9 and/or 10, or of the relative geometries in general.

According to the preferred embodiment of the present invention the element 5 and the element 6 are movable, that is they can be moved in order to narrow or widen the dimensions of the final section of the channel 9. For example, the element 5 can be movable along the direction A-A, while the element 6 can be movable in a direction orthogonal thereto, or vice versa, or each can move both along the direction A-A and along a direction orthogonal thereto. The elements 7 and 8 of the second nozzle 2 can also be movable with respect to each other, as can the elements 5 and 6 to allow control of the air flow in the supply channel 10.

The flow of compressed air is indicated with the arrows P. The air can be supplied to the channels 9 and 10 from a compressor or from an equivalent machine. The channels 9 and 10 can be supplied with compressed air independently or, preferably, the channel 9 can be in fluid communication with the channel 10 through suitable ducts 11 and can thereby receive an air flow therefrom. Regulation of the flow of compressed air through variation of the geometry of the channels 9 and 10 can be performed on the basis of the type of yarns to be treated (material and thickness of the filaments, etc.).

In the case of the unit J in FIG. 1, the supply channel 9 supplies compressed air to the passage 3 according to a direction indicated with the arrows 9*a*. Equivalently, the supply channel 10 supplies compressed air to the passage 4 according to a direction indicated with the arrows 10*a*.

According to the present invention, the first part 6*a* of the outlet portion O of the first nozzle 1 is coupled in an airtight fashion with the element 7 of the second nozzle 2. In this way the main passages 3 and 4 form a single Venturi and the air or fluid injected through the channels 9 and 10. In addition to striking the yarns, also suck air into the Venturi through the inlet I of the first nozzle 1.

Preferably, the inlet portion I of the second nozzle 2 is shaped like a nozzle, and has a narrowing section with respect to the outlet portion 6*b* which precedes it in the direction in which the yarns run.

According to one aspect of the invention, the sections of the main passage 4 of the second nozzle 2 have a greater area with respect to the area of the corresponding sections of the main passage 3 of the first nozzle 1. In particular, the increase in the area of the sections of the passage 4 must be of at least 3% with respect to the area of the sections of the passage 3. Corresponding sections are intended as the sections of the passages 3 and 4, orthogonal to the line A-A, considered at the same distance from the inlet edge of the relative portion 1.

In practice, in the case in which the nozzles are of the circular type, the increase in section of the passage 4 is equivalent to a minimum increase of the diameter thereof of approximately 3% with respect to the diameter of the passage 3 in a corresponding section.

Purely as a non-limiting example of the present invention, indicated below is a practical embodiment of equipment formed of two nozzles in series according to the invention. In this embodiment, the inlet portion I of the first nozzle 1 has an internal diameter $D_1$ of approximately 9 mm and the part 6*b* of its outlet portion O has an internal diameter $D_2$ of approximately 12 mm. The inlet portion I of the second nozzle 2 has a minimum internal diameter $D_3$ of approximately 9.3 mm, or greater, and the part 8*b* of its outlet portion O has a diameter $D_4$ of approximately 12.4 mm or greater. Part 8*a* is the first part of the outlet portion O of the second nozzle 2.

This configuration is particularly advantageous if compared to the single nozzle equipment conventionally used for continuous drawing of yarns.

A first advantage lies in the fact that the Venturi effect which is produced in the passages 3 and 4 is considerably greater with respect to the one obtained with a conventional single nozzle, even with reduced compressed air pressures supplied to the nozzles 1 and 2. The increase Venturi effect which is thereby produced allows the speed of the yarns and tension applied to them to be increased. Consequently, we obtain an increase in the productivity of the system provided with several nozzle units J according to the invention. The table 1 compares the performances which can be obtained with the equipment formed of the unit J in FIG. 1 (and the relative operating parameters) with the performances which can be obtained using the single nozzle equipment according to prior art.

TABLE 1

| | Device according to the invention | Device according to prior art |
|---|---|---|
| Compressed air pressure (bar) | 0.8 | 1.7 |
| Compressed air temperature (° C.) before cooling | approximately 80 | approximately 120 |

TABLE 1-continued

| | Device according to the invention | Device according to prior art |
|---|---|---|
| Speed of yarns (m/minute) | 2000-5000 | 1000-2500 |
| Tension applied (grams) (read with tensiometer on the yarns/filaments) | 35-80 | 20-45 |

As can be noted, the equipment according to the invention, which comprises the nozzle unit J, supplied with compressed air at a pressure lower by approximately 50% with respect to the single nozzle equipment 1 according to prior art, makes it possible to obtain an increase in the speed of the yarns of approximately 100%, and an increase in the tension applied to the yarns of approximately 75%.

Moreover, the temperature of the air delivered from the compressor, and which must be cooled before being supplied to the nozzle unit J, is approximately 40° C. below the temperature found in conventional equipment, with evident advantages with regard to the quality of the yarns treated and the energy consumption required for cooling.

The equipment according to the present invention thereby makes it possible to increase productivity with respect to prior art equipment or, alternatively, with the same performances makes it possible to obtain a noteworthy saving in energy, as it is possible to reduce the air supply pressure to the channels 9 and 10. For example, the unit J can be supplied, instead of by compressors, by high pressure fans which, on average, require lower energy consumption and less costly maintenance with respect to compressors.

The equipment according to the invention can have a third nozzle, provided downstream of the second nozzle 2, and in general several nozzles. What matters is that the main passages of the various nozzles are each configured like a Venturi which works at different intervals of pressure compared to those of the Venturi upstream or downstream thereof.

In particular, each nozzle positioned in series must be characterized, with respect to the nozzle preceding it, by an increase of at least 3% in the area of the section of the passage corresponding to the passages 3 and 4 in the nozzles 1 and 2 shown in FIG. 1.

Moreover, the equipment according to the invention can be used for the treatment of yarns in various phases of their production, for example in the interlacing phase. As the pressure of the fluid supplied to the nozzles is lower than the pressure provided on conventional equipment, the unit J is subject to minimum losses of load, with evident positive effects on the costs of the interlacing system.

The unit J, together with the equipment in which it is fitted, is particularly suitable for drawing yarns, especially synthetic yarns, delivered from the spinning heads. Tests performed showed that the advantages of the unit J with respect to prior art are particularly evident in the case in which the unit J is used for drawing filaments in olefin material, or in polyamide, polyester, etc., and in the production of spunbonded non-woven fabrics.

Figure 2:
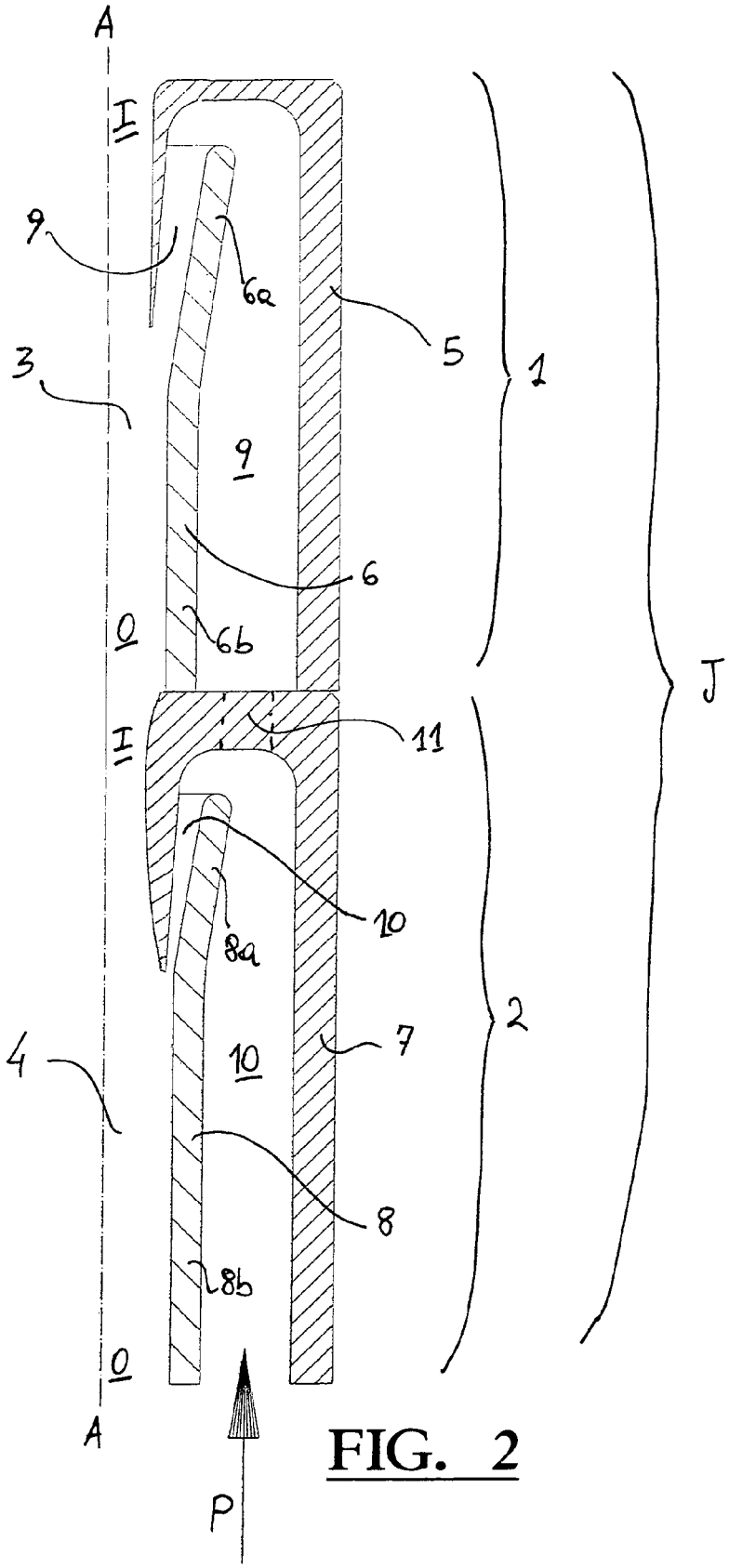
FIG. 2 shows a sectional schematic view of equipment comprising a nozzle unit according to an alternative embodiment of the present invention.

FIG. 2 shows an alternative embodiment of the present invention. The unit J is positioned at the side of the line A-A parallel to which the yarns to be treated pass. The main passages 3 and 4 are thus open laterally or are also delimited by the surfaces of elements external to the unit J. For example, the unit J can be opposite a nozzle unit of the same kind or a wall (not shown), and in this case the passages 3 and 4 can be interposed between the unit J and other elements.

The equipment/apparatus according to the present invention is advantageously used in a procedure to treat synthetic yarns, in particular for the drawing phase of synthetic yarns delivered from spinnerets.

The invention claimed is:

1. Equipment/apparatus for the treatment of synthetic filaments, comprising at least two nozzles each provided with a main passage, through which said filaments pass, each main passage having a section variable between an inlet portion and an outlet portion and into which at least one supply channel opens to supply a fluid according to a preferential direction, wherein:

said at least two nozzles are provided in line, the outlet portion of the main passage of the first nozzle being in communication exclusively with the inlet portion of the main passage of the second nozzle, and wherein the sections of the main passage of the second nozzle have a larger area than the corresponding sections of the main passage of the first nozzle, the increase in area being at least 3%.

2. Equipment/apparatus as claimed in claim 1, wherein said inlet portion and said outlet portion belong to separate elements of each nozzle, movable with respect to one another.

3. Equipment/apparatus as claimed in claim 2, wherein the surfaces defining said at least one supply channel belong to said separate, movable elements.

4. Equipment/apparatus as claimed in claim 3, wherein each said main passage is defined by the totality of the surfaces of an external element, or of a second nozzle unit, and of the surfaces of said first and second nozzles.

5. Equipment/apparatus as claimed in claim 1, wherein said inlet portion of each said main passage is produced in an essentially tubular shape and each said outlet portion is provided with a first funnel-shaped part and a second cylindrical part, each said inlet portion being at least in part inserted into said first part of said outlet portion, without coming into contact therewith, the interstice between said inlet and outlet portions being part of said at least one supply channel.

6. Equipment/apparatus as claimed in claim 5, wherein the inlet portion of said first nozzle has an internal diameter of approximately 9 mm and the second part of its outlet portion has an internal diameter of approximately 12 mm, the inlet portion of said second nozzle has a minimum internal diameter of approximately 9.3 mm, or greater, and the second part of its outlet portion has a diameter of approximately 12.4 mm or greater.

7. Equipment/apparatus as claimed in claim 1, further comprising an airtight coupling between the outlet portion of the main passage of said first nozzle and the inlet portion of the main passage of said second nozzle.

8. Equipment/apparatus as claimed in claim 1, wherein said preferential direction is essentially longitudinal or slightly incident with the direction in which said filaments travel.

9. Equipment/apparatus as claimed in claim 1, wherein said fluid is air.

10. Equipment/apparatus as claimed in claim 1, wherein said synthetic filaments are produced with synthetic yarns in polyamide, polyester or produced with olefin fibres.

11. A method of drawing yarns using the equipment/apparatus as claimed in claim 1.

12. Equipment/apparatus as claimed in claim 1, wherein the two nozzles have substantially the same shape.

* * * * *